US007352235B2

(12) United States Patent
Veenstra et al.

(10) Patent No.: US 7,352,235 B2
(45) Date of Patent: Apr. 1, 2008

(54) CURRENT MIRROR

(75) Inventors: Hugo Veenstra, Eindhoven (NL); Godefridus Adrianus Maria Hurkx, Eindhoven (NL); Johannes Hubertus Antonius Brekelmans, Eindhoven (NL); Dave Willem Van Goor, Eindhoven (NL)

(73) Assignee: NXP B.V., Eindhoven (NL)

( * ) Notice: Subject to any disclaimer, the term of this patent is extended or adjusted under 35 U.S.C. 154(b) by 22 days.

(21) Appl. No.: 10/548,252

(22) PCT Filed: Mar. 1, 2004

(86) PCT No.: PCT/IB2004/050169

§ 371 (c)(1),
(2), (4) Date: Sep. 6, 2005

(87) PCT Pub. No.: WO2004/081232

PCT Pub. Date: Sep. 23, 2004

(65) Prior Publication Data

US 2006/0181257 A1 Aug. 17, 2006

(30) Foreign Application Priority Data

Mar. 10, 2003 (EP) ..... 03100594

(51) Int. Cl.
*G05F 1/10* (2006.01)

(52) U.S. Cl. ..... 327/543; 327/538

(58) Field of Classification Search ..... 327/540, 327/541; 323/315
See application file for complete search history.

(56) References Cited

U.S. PATENT DOCUMENTS

| | | | | |
|---|---|---|---|---|
| 6,407,620 | B1 * | 6/2002 | Hirayama | 327/538 |
| 6,590,371 | B2 * | 7/2003 | Sirito-Olivier | 323/315 |
| 6,677,807 | B1 * | 1/2004 | Brokaw | 327/538 |
| 6,954,058 | B2 * | 10/2005 | Ota et al. | 323/315 |
| 6,956,428 | B1 * | 10/2005 | Voo | 327/538 |
| 2002/0145411 | A1 * | 10/2002 | Sirito-Olivier | 323/315 |

* cited by examiner

*Primary Examiner*—Cassandra Cox

(57) ABSTRACT

The present invention relates to Current mirror for generating a constant mirror ratio, comprising an output transistor ($T_{out}$t) having a base, an emitter and a collector, wherein a current flowing through the collector of said output transistor ($T_{out}$) constitutes an output current ($I_{out}$) of said current mirror and the collector of said output transistor ($T_{out}$) is connectable to an output circuit, a buffer transistor having a base, an emitter and a collector, wherein the emitter of the buffer transistor is connected to the base of the output transistor, a buffer current source for providing a fixed buffer current, wherein said buffer current source is connected to the collector of the buffer transistor, and a buffer base voltage control means having an input connected to the base of the output transistor and an output connected to the base of the buffer transistor, wherein the base voltage control means is adapted to controlling a voltage at the base of the buffer transistor in response to a current at the input of the buffer base voltage control means.

6 Claims, 2 Drawing Sheets

CURRENT MIRROR

This application is a 371 of PCT/IB04/50169 filed on Mar. 1, 2004. This application claims priority to European Applica-on No 03100594-5 filed on Mar. 10, 2003.

The present invention relates to a current mirror for generating a constant input current/output current ratio. The current mirror comprises an output transistor having a base, an emitter and a collector. A current flowing through the collector of said output transistor constitutes an output current of said current mirror. The collector of said output transistor is connectable to an output circuit.

FIG. 1 shows a simple current mirror according to the state of the art. An input current source supplying an input current $I_{in}$ to an input conductor of the circuit is shown in FIG. 1. The input conductor is connected to the base of an output transistor $T_{out}$ and the base and collector of an input transistor $T_{in}$. Thus, the input transistor may be regarded as a diode which has an anode connected to the input current source. The forward voltage drop across the base and emitter of the input transistor $T_{in}$ may be regarded as being constant for typical currents. The emitter of the input transistor $T_{in}$ is connected to an input resistor $R_{in}$ that in turn is connected to ground potential. The collector current of the output transistor $T_{out}$ constitutes the output current $I_{out}$ of the current mirror. The emitter of the output transistor $T_{out}$ is connected to an output resistor $R_{out}$ that in turn is connected to ground potential. An arbitrary output circuit (not shown) is connected to the collector of the output transistor $T_{out}$. Thus, an output voltage $U_{out}$ between the collector of the output transistor $T_{out}$ and ground potential is supplied. This output voltage $U_{out}$ depends on the supply voltage of the arbitrary output circuit. The output voltage depends in particular on the input impedance of the output circuit. The resistors $R_{in}$ and $R_{out}$ are optional, i.e. the conventional current mirror may be implemented without using these resistors. In case resistors are not used the mirror ratio $I_{out}/I_{in}$ depends alone on the size of the transistors $T_{in}$ and $T_{out}$. Under normal operating conditions the mirror ratio K of the conventional current mirror may be determined by the following equation:

$$K=I\text{out}/I\text{in}=n/(1+(n+1)/B).$$

B is the current gain of both transistors $T_{out}$ and $T_{in}$. The current gain of both transistors is chosen to be equal. n stands for the ratio between the emitter area of the output transistor $T_{out}$ and the input transistor $T_{in}$. If input and output resistors $R_{in}$ and $R_{out}$ are used, the quotient $R_{in}/R_{out}$ is chosen to be equal to n. In this case the above equation also describes the conventional current mirror containing input and output resistors. The output resistor $R_{out}$ increases the output impedance of the current mirror and reduces the current noise. In order for the current mirror to work properly the collector-emitter voltage of the output transistor $U_{ce}(T_{out})$ has to be larger than the saturation voltage of the output transistor $U_{ce,sat}(T_{out})$ and lower than the collector-emitter break down voltage $U_{brce}(T_{out})$ of the output transistor. If the collector-emitter voltage of the output transistor $U_{ce}(T_{out})$ exceeds the break down voltage due to fluctuations in the output voltage $U_{out}$, the current mirror does not operate accurately anymore, i.e. the mirror ratio is changed. By increasing the voltage drop across the output resistor $R_{out}$ the maximum output voltage Uout for proper operation of the current mirror may be increased, since Uout equals $U_{ce}(T_{out})$+Urout, wherein $U_{rout}$ depicts the voltage drop cross the output resistor $R_{out}$. As a draw back the minimum output voltage Uout for proper operation of the current mirror is also increased. It is good to increase the output voltage range of the current mirror in order to provide for a stable and accurate operation of the current mirror, even if output voltage fluctuations occur. This can be achieved by providing an output transistor $T_{out}$ that has a large collector-emitter break down voltage $U_{brce}(T_{out})$. However, modern silicon and silicon-germanium transistors used in integrated circuits are designed to operate at constantly increasing frequencies, which in turn leads to reducing the break down voltages of these transistors. It is therefore desirable to provide a current mirror that operates correctly even if the collector-emitter voltage of the output transistor $U_{ce}(T_{out})$ exceeds the break down voltage of the output transistor. When the output transistor $T_{out}$ is operated in the break down region, an additional current flows from the collector of transistor $T_{out}$ into its base. These base currents are generated because of an avalanche effect occurring at the base-collector junction of the transistor $T_{out}$. The size of the avalanche current is equivalent to:

$$I_{av}=(M-1)I_s*\exp(U_{be}/U_T).$$

$U_{be}$ stands for the base/emitter voltage of the output transistor $T_{out}$. $U_T$ is the temperature voltage of the output transistor. $I_s$ is the reverse saturation current of the output transistor. M is a factor that depends on the collector-base voltage of the output transistor $U_{cb}(T_{out})$. If the collector-base voltage of the output transistor is an order of magnitude lower than the collector-base break down voltage, the factor M is approximately equal to 1. The avalanche current may be neglected. Factor M may be calculated from: $M=1/[1-(U_{cb}(T_{out})/BVCBO)^L]$. The typical value for L is 3 and BVCBO is the collector-base break down voltage at open emitter. As can be seen from this formula, factor M approaches infinity for $U_{cb}(T_{out})$ close to the collector-base break down voltage BVCBO. If the avalanche current is taken into account, the mirror ratio of the current mirror according to FIG. 1 may be described by the following formula:

$$K=I_{out}/I_{in}=n\cdot M/[1+n/B-n(M-1)]$$

Since M depends on the collector base voltage of the output transistor $U_{cb}(T_{out})$ the mirror ratio depends on the output voltage. The avalanche current flowing into the base of the output transistor $T_{out}$ reduces the base current of the output transistor $T_{out}$. Since the current source in FIG. 1 produces a constant current, which is equivalent to the base current of the output transistor and the current flowing through the input resistor $R_{in}$, a reduction in the base current of the output transistor is compensated by an increase of the current flowing through the input resistor $R_{in}$. An increased current flow through the input resistor $R_{in}$ in turn leads to an increased voltage drop cross the input resistor, since U=R*I. A constant voltage drop across the base emitter junction of the input transistor $T_{in}$, may be assumed under normal operating conditions. Therefore, the base voltage of the output transistor $T_{out}$ increases. Finally, the increased base voltage of the output transistor increases the collector current (=output current) of the output transistor $T_{out}$. In order to prevent an increase of the output current, the base voltage of the output transistor must be maintained on a constant level.

An improved current mirror according to the state of the art is shown in FIG. 2. In FIGS. 1 and 2 the same reference signs depict the same components. In FIG. 2 a buffer transistor $T_{buff}$ and a buffer resistor $R_{buff}$ have been added to the circuit of FIG. 1. The base of the buffer transistor $T_{buff}$ is connected to the input conductor of the input current source $I_{in}$. The collector of the buffer transistor $T_{buff}$ is connected to an input voltage source providing a constant input voltage $U_{in}$. The emitter of said buffer transistor connects with the base of the output transistor $T_{out}$ and the buffer resistor $R_{buff}$. The resistors $R_{in}$, $R_{buff}$ and $R_{out}$ are all connected to ground potential. The bias current of the buffer transistor $T_{buff}$ is dimensioned in such a way, that the base current flowing into the buffer transistor is negligible compared to the current flowing through the input transistor $T_{in}$. Therefore, the base voltage of the buffer transistor $T_{buff}$ is approximately equal to $R_{in}*I_{in}$ plus a constant voltage drop across the input transistor $T_{in}$. The base voltage of the buffer transistor $T_{buff}$ may be assumed to be constant. The input voltage source, the buffer transistor $T_{buff}$ and the buffer resistor $R_{buff}$ constitute as a first approximation a current source providing a fairly constant current flowing through the buffer resistor $R_{buff}$. As long as the current flowing through the buffer resistor $R_{buff}$ is held constant, the base voltage of the output transistor is left unchanged. The primary purpose of inserting the buffer transistor and the buffer resistor into the current mirror is to maintain a constant base voltage at the output transistor $T_{out}$, even if a negative avalanche current is inserted into the buffer of the output transistor. The effect of a negative current in the base of the output transistor $T_{out}$ on the circuit of FIG. 2 may be explained in detail in the following way. The negative base current adds to the current flowing through the buffer resistor $R_{buff}$. Consequently, the emitter voltage of the buffer transistor is raised. Since the base voltage of the buffer transistor $T_{buff}$ is approximately constant, a rise in the emitter voltage of the transistor $T_{buff}$ leads to a reduced base emitter voltage drop at the buffer transistor $T_{buff}$. As a consequence the emitter current of the buffer transistor $T_{buff}$ is reduced.

The current mirror of FIG. 2 has several drawbacks. The current flowing constantly through the buffer resistor $R_{buff}$ leads to increased power dissipation of the current mirror. The functioning of the circuit is limited by the size of the current flowing through the buffer transistor $R_{buff}$. If the negative base current flowing to the base of the output transistor $T_{out}$ is equal to or larger than the current flowing through the buffer resistor under normal operating conditions, reducing the emitter current emanating from the buffer transistor $T_{Buff}$ cannot compensate an increase in the buffer current.

It is therefore object of the present invention to provide a current mirror for generating a constant mirror ratio that operates accurately for a large output voltage range.

The problem is solved by the current mirror for generating a constant mirror ratio according to the present invention. The current mirror comprises an output transistor ($T_{out}$) having a base, an emitter and a collector. A current flowing through the collector of said output transistor ($T_{out}$) constitutes an output current ($I_{out}$) of said current mirror. The collector of said output transistor ($T_{out}$) is connectable to an output circuit. The current mirror further comprises a buffer transistor having a base, an emitter and a collector. The emitter of the buffer transistor is connected to the base of the output transistor. The current mirror further comprises a buffer current source for providing a fixed buffer current. The buffer current source is connected to the collector of the buffer transistor. The current mirror comprises a buffer base voltage control means having an input connected to the base of the output transistor and an output connected to the base of the buffer transistor. The base voltage control means is adapted to controlling a voltage at the base of the buffer transistor in response to a current at the input of the buffer base voltage control means. If the output transistor is operated at output voltages exceeding the base emitter break down voltage of the output transistor, negative base currents are injected into the base of the output transistor due to an avalanche effect at the base emitter junction of the output transistor. The base current of the output transistor is reduced. If the buffer transistor is operated in the normal operating range, the collector and emitter current of the buffer transistor are approximately equal to each other. Since the collector of the buffer transistor is connected to a buffer current source, the emitter current of the buffer transistor is constant, even if the base current of the output transistor is reduced. Therefore the reduction in the base current of the output transistor must lead to an increase of the current at the input of the base voltage control means. The base voltage control means may reduce the voltage at the base of the buffer transistor in response to an increase in the input current Since the collector current of the buffer transistor is fixed by the buffer current source, the base emitter voltage drop at the buffer transistor must be assumed to be constant. Therefore a reduction in the voltage at the base of the buffer transistor leads to an equivalent drop in the voltage at the emitter of the buffer transistor. Since the emitter of the buffer transistor is connected to the base of the output transistor, the voltage at the emitter of the buffer transistor and at the base of the output transistor are equal to each other. Consequently, the voltage at the base of the output transistor is reduced. The base voltage of the output transistor is reduced whenever negative base currents occur due to an avalanche effect. Thereby an increase in the collector current of the output transistor due to output voltages exceeding the collector emitter break down voltage of the output transistor may be compensated.

The current mirror according to the present invention operates accurately for a larger output voltage range than the current mirrors according to the state of the art since the compensation of negative base currents of the output transistor is not limited by the size of the buffer current.

Preferably the current mirror according to the present invention comprises an input conductor. The input conductor is connected to the base of the buffer transistor and an input resistor. The input conductor is connectable to an input current source. The buffer base voltage control means comprises a buffer current mirror having an input and an output. The input of the buffer current mirror constitutes the input of the buffer base voltage control means and the output of the buffer current mirror constitutes the output of the buffer base voltage control means.

The base voltage of the buffer transistor is controlled according to this embodiment by mirroring the negative base current of the output transistor onto the base of the buffer transistor. The negative base current of the output transistor increases the current flowing into the input of the current mirror. This increase of input current is mirrored onto the output of the current mirror. The sum of the currents supplied to the input resistor, the output of the buffer current mirror and the base of the buffer transistor is fixed, if the input conductor is connected to an input current source. Since the collector current of the buffer transistor is fixed by the buffer current source, the base current of the buffer transistor must be assumed to be constant. An increase of the current supplied to the output of the buffer current mirror must lead to a decrease in the current supplied to the input resistor. The voltage drop across the input resistor is decreased. Consequently, the voltage at the base of the buffer transistor is decreased.

The buffer current mirror preferably comprises a buffer current mirror input transistor having a base, a collector and an emitter. The collector of the buffer current mirror input transistor constitutes the input of the current mirror. The buffer current mirror preferably further comprises a buffer current mirror output transistor having a base, a collector and an emitter. The collector of the buffer current mirror output transistor constitutes the output of the buffer current mirror. The base of the buffer current mirror output transistor and the base of the buffer current mirror input transistor are connected to each other. The voltage at the base of the buffer current mirror input transistor may be chosen in such a way, that the fixed buffer current predominantly flows through the collector of the buffer current mirror input transistor. Since the base emitter voltage of the buffer current mirror output transistor equals the base emitter voltage drop of the buffer current mirror input transistor, these two transistors form a current mirror with a collector current ratio k. The emitter area of the buffer current mirror input transistor is equal to k times the emitter area of the buffer current mirror output transistor. For correct operation of the overall current mirror ratio should be chosen to be the reciprocal value of the buffer current mirror ratio. This buffer current mirror provides a constant current mirror ratio without fixing the voltage at its input terminal. The current mirror of FIG. 1 fixes the voltage at its input terminal. This is not possible in the current mirror according to the invention, since the voltage at the input of the buffer current mirror has already been defined as the emitter voltage of the buffer transistor. Therefore, a current mirror is needed that accepts any input voltage.

A buffer mirror ratio of the buffer current mirror is preferably chosen to be the reciprocal value of the mirror ratio of the current mirror. This can be achieved by choosing the emitter area ratio of the buffer current mirror output transistor and the buffer current mirror input transistor to be equal to the reciprocal value of the mirror ratio of the current mirror. This buffer mirror ratio is needed to provide the exact amount of compensation current to the input current. The input current is mirrored n times towards the output current. Any correction factor to this input current will also be seen n times as large in the output current. The avalanche current (to be corrected) appears exactly once in the output current. Since this avalanche current is corrected in the input current, the input current must be corrected by the scaled amount, so 1/n times. This current mirror requires an input current equal to (1+1/m) times the buffer current, wherein the overall current mirror ratio is equal to m/(1+1/m).

The buffer current mirror comprises preferably a PMOS transistor having a gate, a source and a drain. The source of the PMOS transistor is connected to the collector of the buffer transistor and the drain of the PMOS transistor is connected to the base of the buffer current mirror input transistor. The drain of the PMOS transistor is adapted to providing a base voltage to the buffer current mirror input transistor. This base voltage must be high enough for the collector buffer current mirror input transistor to absorb the predominant part of the buffer current emanating from the emitter of the buffer transistor. At the same time the current flowing to the source of the PMOS transistor must be negligible in comparison with the buffer current. Instead of a PMOS transistor a PnP transistor may be implemented accordingly.

The above and other features and advantages of the invention will be apparent from the following description of the exemplary embodiments of the invention with reference to the accompanying drawings, in which.

In all FIGS. 1 to 4 an output current $I_{out}$ is provided to an arbitrary output circuit (not shown). The collector of the output transistor $U_{out}$ is connected to the output circuit. The output circuit is connected between SUPPLY potential and $U_{out}$. Thus $U_{out}$ constitutes both the output voltage of the current mirrors shown in FIG. 1 to 4 and the voltage supplied to the arbitrary output circuit. The size of the output voltage $U_{out}$ depends on the output circuit and particularly on the input impedance of the output circuit.

Figure 1:
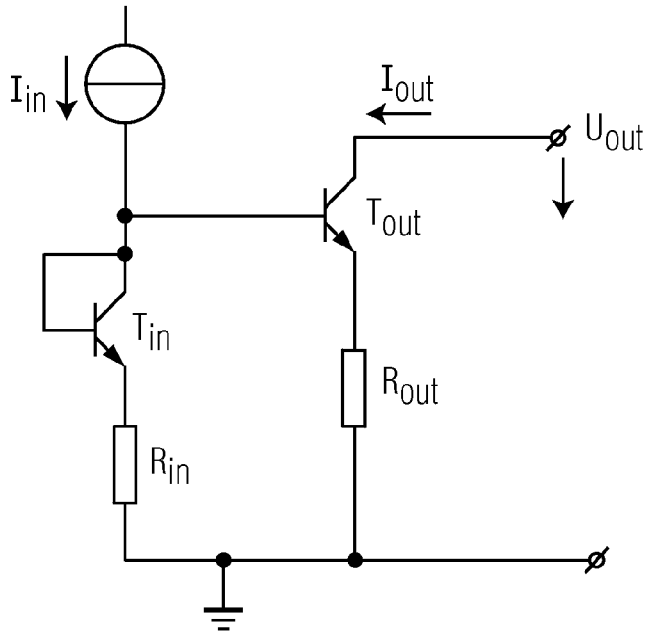
FIG. 1 shows a simple current mirror according to the state of the art.
Figure 2:
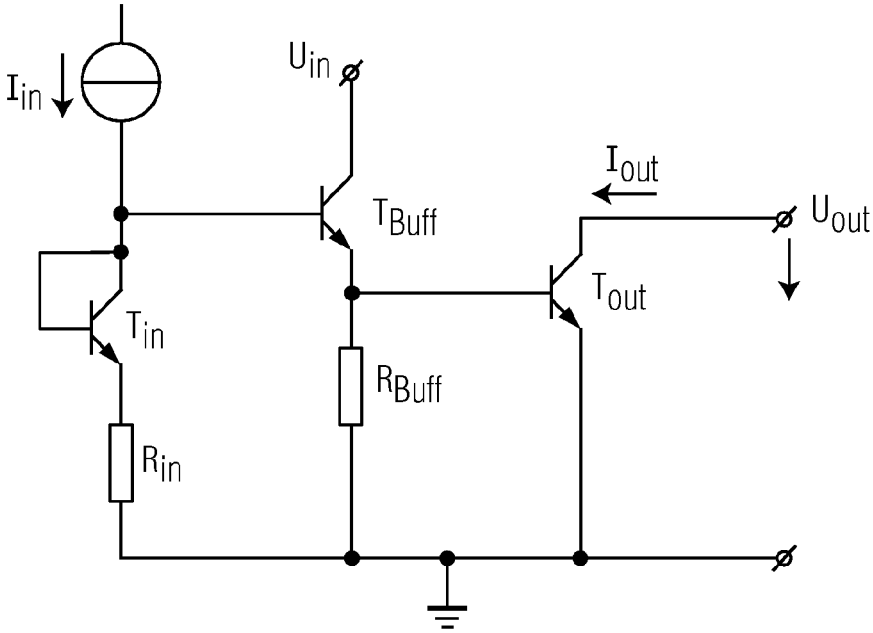
FIG. 2 PRIOR ART
FIG. 2 shows a current mirror with a buffer according to the state of the art.
Figure 3:
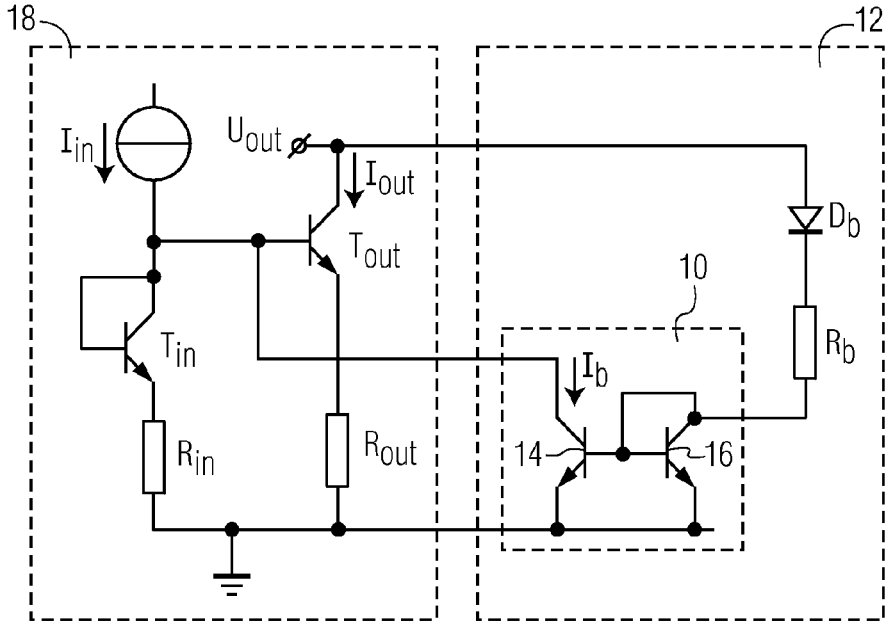
FIG. 3 shows a first embodiment of the current mirror according to the present invention.

The first embodiment of the present invention shown in FIG. 3 comprises an input transistor $T_{in}$, an output transistor $T_{out}$ an input resistor $R_{in}$ and an output resistor $R_{out}$. Identical reference signs in FIG. 1 to 4 depict the same components. Please refer to the detailed description of the conventional current mirrors shown in FIGS. 1 and 2. The collector current of the output transistor constitutes the output current of the current mirror. An input current source is provided in order to provide a constant input current $I_{in}$. The input transistor $T_{in}$ is connected to the input current source with its collector and base. Therefore the input transistor $T_{in}$ may be regarded as a diode. The input resistor $R_{in}$ is connected to the emitter of the input transistor $T_{in}$ and is connected to ground potential. A buffer transistor $T_{Buff}$ is connected to the input current source via its base. The emitter of the buffer transistor $T_{Buff}$ is connected to the base of the output transistor $T_{out}$. The emitter of output transistor $T_{out}$ is connected to ground via the output resistor $R_{out}$.

A first difference between the current mirror of FIG. 3 and the current mirror of FIG. 2 is the use of a buffer current source in order to generate a buffer current $I_{Buff}$. The buffer current $I_{Buff}$ is provided to the collector of the buffer transistor $T_{Buff}$. If the buffer transistor $T_{Buff}$ is operated under normal operating conditions, i.e. the collector emitter voltage of the buffer transistor $T_{Buff}$ is larger than the collector emitter saturation voltage and lower than the collector emitter break down voltage, the collector current of the buffer transistor $T_{Buff}$ depends almost exclusively on the base emitter voltage of the buffer transistor $T_{Buff}$. A given collector current of the buffer transistor $T_{Buff}$ implicates a given base emitter voltage drop at the buffer transistor $T_{Buff}$, which is almost independent of the collector emitter voltage of the buffer transistor $T_{Buff}$. Therefore, the base emitter voltage drop of the buffer transistor $T_{Buff}$ is defined by the buffer current $I_{Buff}$ provided to the collector of the buffer transistor $T_{Buff}$. The base current of the buffer transistor $T_{Buff}$ is almost exclusively a function of the base emitter voltage of the buffer transistor $T_{Buff}$ under normal operating conditions. For a given base emitter voltage of the buffer transistor $T_{Buff}$ a predetermined base current may be found. Hence, the buffer current source defines the base current of the buffer transistor $T_{Buff}$. The voltage at the base of the buffer transistor $T_{Buff}$ is equal to the voltage drop across the input resistor $R_{in}$ plus a voltage drop across the input transistor $T_{in}$. The voltage drop across input transistor $T_{in}$ may be assumed to be constant, since the input transistor $T_{in}$ is operated as a diode. Hence, the base voltage of the buffer transistor depends on the current flowing through the input resistor $R_{in}$. Since the base emitter voltage of the buffer transistor $T_{Buff}$ is fixed for a given buffer current $I_{Buff}$, the emitter voltage of the buffer transistor $T_{Buff}$ (equal to base voltage of output transistor $T_{out}$) can be controlled by changing the current flowing through the input resistor $R_{in}$. This effect is used to control the base voltage of the output transistor $T_{out}$. A reduction in the current flowing through the input resistor $R_{in}$ is effected by a buffer current mirror 10, if a negative base current is injected into the base of the output transistor $T_{out}$. The buffer current mirror 10 has an input, which is connected to the base of the output transistor $T_{out}$ and the emitter of the buffer transistor $T_{Buff}$. The current emanating from the emitter of the buffer transistor $T_{Buff}$ corresponds approximately to the buffer current $I_{Buff}$ and is fixed. Therefore, the buffer current $I_{Buff}$ is equal to the base current of the output transistor $T_{out}$ plus the input current of the current mirror 10. If a negative base current is injected into the base of the output transistor $T_{out}$ the base current of the output transistor $T_{out}$ is reduced. The input current of the buffer current mirror 10 must increase by the same amount. Otherwise the sum of the input current of the buffer current mirror 10 and the base current of the output transistor $T_{out}$ would cease to correspond to the buffer current $I_{Buff}$. The negative base currents from the output transistor $T_{out}$ are injected completely into the input of the buffer current mirror 10. The output of the buffer current mirror 10 is connected to the base of the buffer transistor $T_{Buff}$ and the input current source. An increase in the input current of the buffer current mirror 10 is mirrored onto the output current, i.e. the output current increases proportionally. The fixed input current of the buffer current mirror 10 is equal to the sum of the current flowing through the input resistor $R_{in}$ the current in the base of the buffer transistor $T_{Buff}$ and the current flowing to the output of the buffer current mirror 10. The base current of the buffer transistor $T_{Buff}$ is fixed. Consequently an increase in the output current of the buffer current mirror 10 must lead to a reduction in the input resistor current. Reducing the current flowing through the input resistor $R_{in}$ in turn reduces the voltage at the base of the output transistor $T_{out}$. Thereby the effect of negative base currents on the output transistor $T_{out}$ may be compensated.

Figure 4:
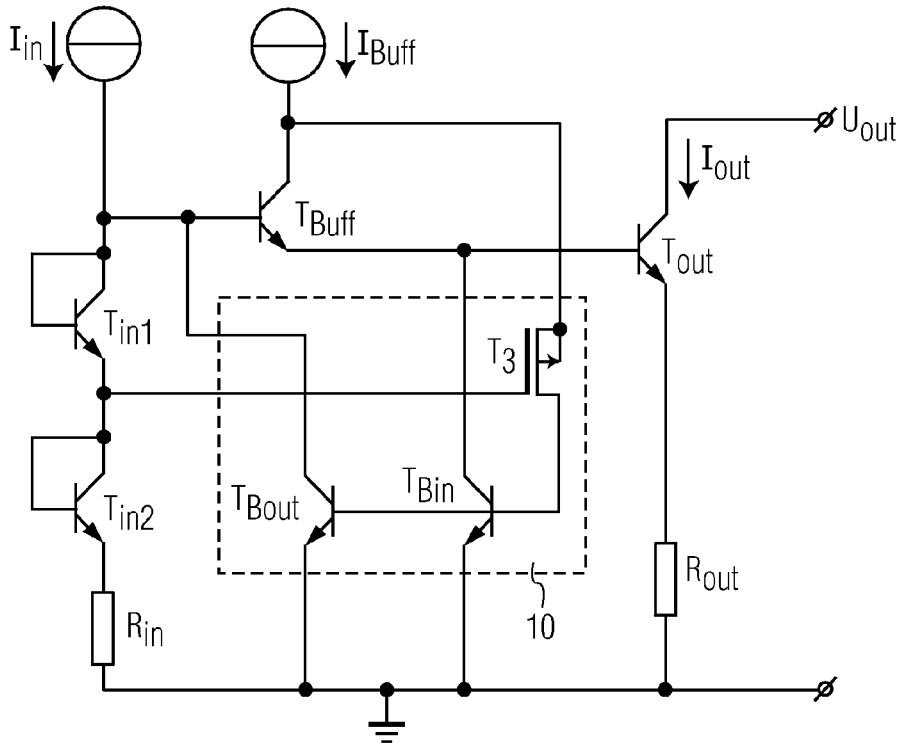
FIG. 4 shows a second embodiment of the current mirror according to the present invention.

The second embodiment of the present invention shown in FIG. 4 contains a special current mirror 10, which is particularly adapted to the requirements of a buffer current mirror. This buffer current mirror allows a correct current copying without fixing the voltage at its input terminal. Furthermore, two input transistors $T_{in1}$ and $T_{in2}$ are used in the second embodiment. The input transistors $T_{in1}$ and $T_{in2}$ are operated as diodes and connected in line to the input current source and the base of the buffer transistor $T_{Buff}$. Otherwise the current mirror shown in FIG. 4 corresponds to the current mirror shown in FIG. 3. The input transistors $T_{in1}$, and $T_{in2}$ do not change the operating principle of the current mirror. The voltage at the base of the buffer transistor $T_{Buff}$ may still be controlled by changing the current flowing through the input resistor $R_{in}$. The base emitter voltage drop across the input transistors $T_{in1}$, and $T_{in2}$ may be assumed to be constant, since they are operated as diodes. The gate of a PMOS transistor $T_3$ is connected to the emitter of $T_{in1}$ and the collector of $T_{in2}$. Since the gate current of a PMOS transistor is approximately zero under normal operating conditions, this connection has no effect on the current flowing through the input resistor. The purpose of connecting the gate of the PMOS $T_3$ transistor with the input transistors $T_{in1}$ and $T_{in2}$ is to define the gate voltage of $T_3$ in an appropriate way. The source of transistor T3 is connected to the collector of the buffer transistor $T_{Buff}$. This does not change the functioning of the current mirror, since the PMOS transistor is designed and operated in such a way, that the current flowing to the source of transistor T3 is negligible in comparison to the buffer current $I_{Buff}$. The main purpose of transistor T3 is to provide a proper base voltage of transistor $T_{Bin}$. The buffer current mirror 10 shown in FIG. 4 consists of the PMOS transistor T3, a buffer current mirror input transistor $T_{Bin}$ and a buffer current mirror output transistor $T_{Bout}$. The base of the input transistor $T_{Bin}$ and the base of the output transistor $T_{Bout}$ are connected to each other. The PMOS transistor T3 defines the base voltage of the input and output transistors $T_{Bin}$ and $T_{Bout}$ respectively. The input of the buffer current mirror 10 corresponds to the collector of the input transistor $T_{Bin}$. The base emitter voltage drop at the input transistor $T_{Bin}$ is chosen in such a way, that the buffer current $I_{Buff}$ is predominantly conducted through the input transistor $T_{Bin}$. The output of the buffer current mirror 10 corresponds to the collector of the output transistor $T_{Bout}$. The emitters of the buffer current mirror input and output transistors $T_{Bin}$ and $T_{Bout}$ are both connected to ground potential. An increase in the input current of the buffer current mirror leads to an increased base emitter voltage drop at the input transistor $T_{Bin}$ of the buffer current mirror. Since the base of the input transistor $T_{Bin}$ and the output transistor $T_{Bout}$ are connected to each other, the increase of the base emitter voltage of the input transistor $T_{Bin}$ leads to a corresponding increase in the base emitter voltage of the output transistor $T_{Bout}$. The collector current of the input transistor $T_{Bin}$ corresponds approximately to $Ic(T_{Bin})=\exp(U_{be}(T_{in})/U_T)*I_s(T_{Bin})$. The collector current of the output transistor $T_{Bout}$ corresponds approximately to $Ic(T_{out})=\exp(U_{be}(T_{Bout})/U_T)*I_s(T_{Bout})$. $U_T$ is the temperature voltage of the output transistor and input transistor of the buffer current mirror. Since the base emitter voltage $U_{be}$ of the output transistor $T_{Bout}$ and the input transistor $T_{Bin}$ are equal to each other, the buffer current mirror ratio corresponds to $I_c(T_{Bout})/Ic(T_{Bin})=I_s(T_{Bout})/I_s(T_{Bin})$. Is stands for the reverse saturation current of the output transistor $T_{Bout}$ and the input transistor $T_{Bin}$ respectively. The reverse saturation current of a transistor depends on the design of the transistors and in particular on the emitter area of the transistor. Therefore the buffer current mirror ratio may be defined by choosing the emitter areas of the input and output transistors $T_{Bin}$ and $T_{Bout}$ of the buffer current mirror in an appropriate way.

For correct operation, the circuits of FIGS. 3 and 4 require an input current $I_{in}$ which is equal to (1+1/m) times the buffer current $I_{Buff}$ provided by the buffer current source, i.e. $Iin=(1+1/m)¤I_{Buff}$, wherein the overall current mirror ratio is chosen to be equal to m/(1+1/m). The buffer current mirror ratio $Ic(T_{Bout})/Ic(T_{Bin})$ must be chosen to correspond to the reciprocal value of the overall current mirror ration $I_{out}/I_{in}$.

It is clear to the person skilled in the art, that the present invention may be implemented in various ways not explicitly mentioned in this application. The previous embodiments are only exemplary and do not limit the scope of the invention. The invention is defined by the following claims.

The invention claimed is:

1. Current mirror for generating a constant mirror ratio between an output current and an input current, comprising:

an output transistor having a base, an emitter and a collector, wherein a current flowing through the collector of said output transistor constitutes said output current of said current mirror and the collector of said output transistor is connectable to an output circuit, a buffer transistor having a base, an emitter and a collector, wherein the emitter of the buffer transistor is connected to the base of the output transistor, an input conductor, wherein the input conductor is connected to the base of the buffer transistor and an input resistor and the input conductor is connectable to an input current source providing said input current, a buffer current source for providing a fixed buffer current, wherein said buffer current source is connected to the collector of the buffer transistor, and a buffer base voltage control means having an input connected to the base of the output transistor and an output connected to the base of the buffer transistor, wherein the base voltage control means is adapted to controlling a voltage at the base of the buffer transistor in response to a current at the input of the buffer base voltage control means.

2. Current mirror according to claim 1, wherein the buffer base voltage control means comprises a buffer current mirror having an input and an output, wherein the input of the buffer current mirror constitutes the input of the buffer base voltage control means and the output of the buffer current mirror constitutes the output of the buffer base voltage control means.

3. Current mirror according to claim 2, wherein the buffer current mirror comprises a buffer current mirror input transistor having a base, a collector and an emitter, wherein the collector of the buffer current mirror input transistor constitutes the input of the current mirror, and a buffer current mirror output transistor having a base, a collector and an emitter, wherein the collector of the buffer current mirror output transistor constitutes the output of the buffer current mirror and the base of the buffer current mirror output transistor and the base of the buffer current mirror input transistor are connected to each other.

4. Current mirror according to claim 2, wherein a buffer mirror ratio of the buffer current mirror is chosen to be the reciprocal value of the mirror ratio of the current mirror.

5. Current mirror according to claim 3, wherein the buffer current mirror further comprises a PMOS transistor having a gate, a source and a drain, wherein the source of the PMOS transistor is connected to the collector of the buffer transistor and the drain of the PMOS transistor is connected to the base of the buffer current mirror input transistor.

6. Current mirror according to claim 3, wherein the buffer current mirror further comprises a pnp-type bipolar transistor having a base, a collector and an emitter, wherein the emitter of the pnp-type bipolar transistor is connected to the collector of the buffer transistor and the collector of the pnp-type bipolar transistor is connected to the base of the buffer current mirror input transistor.

* * * * *